US008714765B2

(12) United States Patent
Miyazawa

(10) Patent No.: US 8,714,765 B2
(45) Date of Patent: May 6, 2014

(54) ELECTRIC POWER TOOL

(71) Applicant: Masamichi Miyazawa, Anjo (JP)

(72) Inventor: Masamichi Miyazawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 13/675,600

(22) Filed: Nov. 13, 2012

(65) Prior Publication Data

US 2013/0148335 A1 Jun. 13, 2013

(30) Foreign Application Priority Data

Dec. 8, 2011 (JP) ..... 2011-269286

(51) Int. Cl.
*B25B 23/18* (2006.01)
*F21V 33/00* (2006.01)

(52) U.S. Cl.
USPC ..... 362/119; 362/109; 362/120

(58) Field of Classification Search
None
See application file for complete search history.

(56) References Cited

U.S. PATENT DOCUMENTS 6,494,590 B1 * 12/2002 Paganini et al. ..... 362/119
6,725,945 B2 * 4/2004 Sugimoto et al. ..... 173/117

FOREIGN PATENT DOCUMENTS

| | | |
|---|---|---|
| JP | A-2001-057293 | 2/2001 |
| JP | A-2002-154065 | 5/2002 |
| JP | A-2002-301669 | 10/2002 |
| JP | A-2002-307325 | 10/2002 |
| JP | A-2003-245875 | 9/2003 |
| JP | A-2004-114299 | 4/2004 |
| JP | A-2007-283447 | 11/2007 |

* cited by examiner

*Primary Examiner* — Natalie Walford
(74) *Attorney, Agent, or Firm* — Oliff PLC

(57) ABSTRACT

In a rechargeable impact driver, a light unit provided in an extension portion of a housing is provided with a substrate, an LED disposed on the substrate so as to face forward, and a lens provided in front of the LED. The LED is used for an illumination function to irradiate ahead of a bit by lighting and for a notification function to notify a decrease in a battery level of a battery pack by flashing.

8 Claims, 6 Drawing Sheets

ELECTRIC POWER TOOL

BACKGROUND OF THE INVENTION

This application claims the benefit of Japanese Patent Application Number 2011-269286 filed on Dec. 8, 2011, the entirety of which is incorporated by reference.

TECHNICAL FIELD

The present invention relates to an electric power tool such as a rechargeable impact driver.

BACKGROUND ART

In an electric power tool such as a rechargeable impact driver, as disclosed in Japanese Patent Application Publication No. 2007-283447 (JP 2007-283447 A), for example, an LED serving as a light emitter is provided in a housing in a diagonal upward manner. The LED is caused to emit light to irradiate ahead of a bit at the time of driving a motor. On the other hand, an electric circuit substrate is placed at a connection portion of a battery pack formed under a grip section. In this electric circuit substrate, an LED for displaying a fastening speed, a battery level, and the like is incorporated, so that a display of the LED can be checked through a transparent display check portion.

In the conventional electric power tool, since the LED for an illumination function and the LED for a notification function to notify a battery level and the like are provided separately, electric wiring is complicated, which causes an increase in cost, and in addition, which may hinder compactification of the electric power tool itself.

SUMMARY OF THE INVENTION

In view of this, the present invention is intended to provide an electric power tool in which electric wiring can be simplified and which suppresses an increase in cost and allows downsizing even if a light emitter such as an LED is used for a plurality of functions including the illumination function.

In order to achieve the above object, an electric power tool according to a first aspect of the present invention includes a housing, and at least one light emitter provided in the housing and used for a plurality of functions including an illumination function to irradiate ahead.

According to a second aspect of the present invention, in the configuration of the first aspect, the electric power tool further includes a battery serving as a power supply, and a function except the illumination function is a notification function to notify a decrease in a battery level of the battery.

According to a third aspect of the present invention, in the configuration of the first aspect, lenses are provided at respective sides of the light emitter so as to project to right and left sides of the housing so that the lenses are visible from a back side of the housing.

According to a fourth aspect of the present invention, in the configuration of the second aspect, the decrease in the battery level of the battery is notified by flashing of the light emitter.

According to a fifth aspect of the present invention, in the configuration of the third aspect, the lenses are diffusion lenses.

According to a sixth aspect of the present invention, in the configuration of the third aspect, another lens is provided in front of the light emitter such that the lens is formed integrally with the lenses provided at the respective sides of the light emitter.

According to the first aspect, since one light emitter is used for a plurality of functions including an illumination function, even if the light emitter is used for the plurality of functions, electric wiring is simplified. This makes it possible to suppress an increase in cost and to achieve downsizing.

According to the second aspect, in addition to the effect of the first aspect, it is possible to easily know the decrease in the battery level by using the light emitter.

According to the third aspect, in addition to the effect of the first aspect, it is possible to easily recognize a function by the light emitter even when the electric power tool is viewed from its back side.

According to the fourth aspect, in addition to the effect of the second aspect, it is possible to surely notify the decrease in the battery level distinctively from the illumination function.

According to the fifth aspect, in addition to the effect of the third aspect, it is possible to improve visibility of the light emitter more.

According to the sixth aspect, in addition to the effect of the third aspect, it is possible to achieve easy assembling and also possible to easily perform positioning relative to the light emitter.

DETAILED DESCRIPTION OF THE EMBODIMENTS

An embodiment of the present invention is explained below with reference to drawings.

Figure 1:
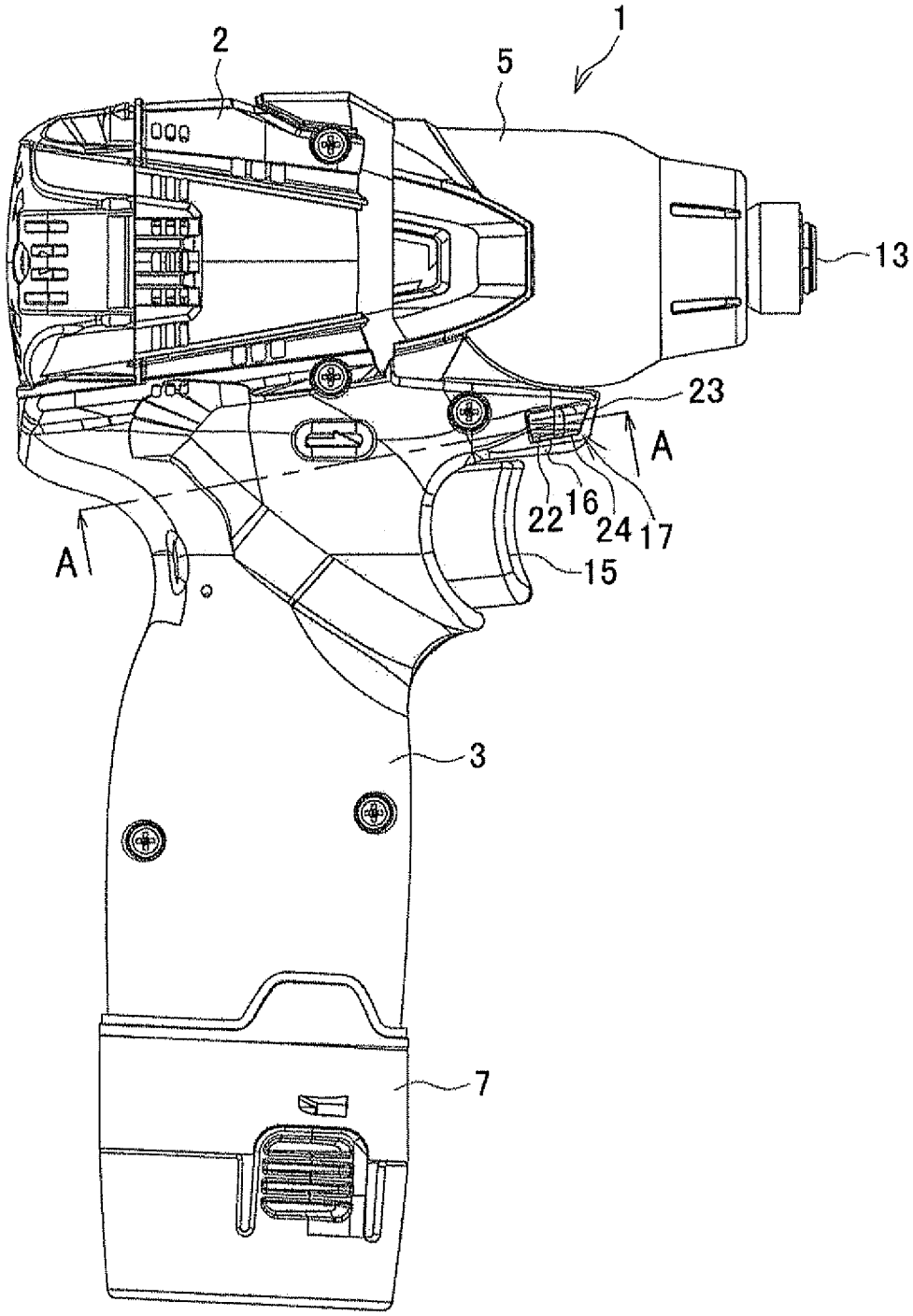
FIG. 1 is a side view of a rechargeable impact driver.
Figure 2:
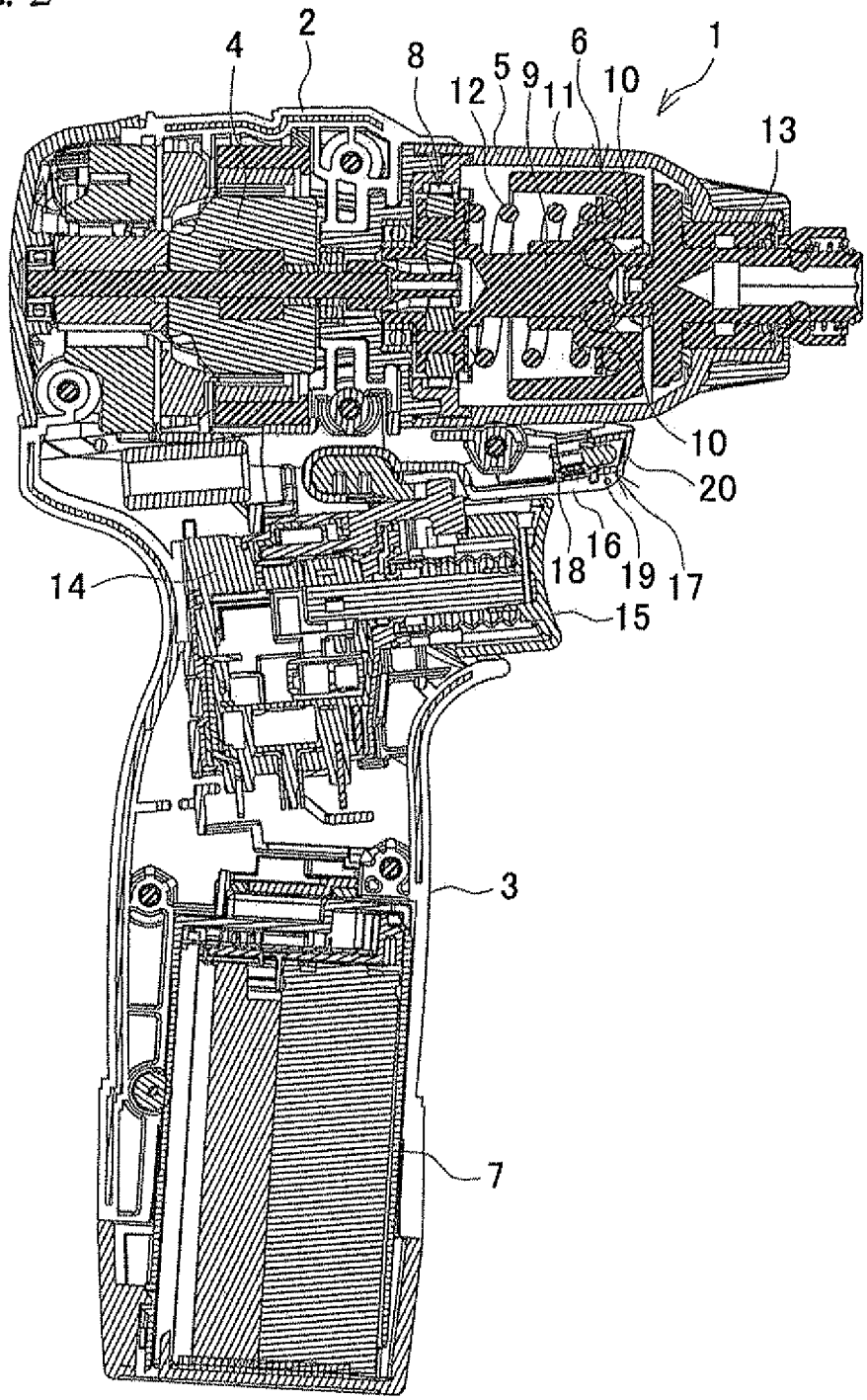
FIG. 2 is a longitudinal sectional view of the rechargeable impact driver.

FIG. 1 is a side view of a rechargeable impact driver 1, which is one example of an electric power tool. FIG. 2 is a longitudinal sectional view of the rechargeable impact driver 1. In this rechargeable impact driver 1, a motor 4 is accommodated in an upper rear part (the right side in FIGS. 1 and 2 is assumed to be the front side) of a housing 2, and a handle 3 is provided contiguous to a lower end of the housing 2. A hammer case 5 that accommodates an impact mechanism 6 is connected to a front of the housing 2. A battery pack 7 serving as a power supply is attached to a lower end of the handle 3. The impact mechanism 6 has a well-known configuration. In impact mechanism 6, a hammer 11 is connected, via balls 10, 10, to a spindle 9 to which rotation is transmitted from the motor 4 via a planetary gear speed reduction mechanism 8. Further, in impact mechanism 6, the hammer 11 is engaged, by a coiled spring 12 that is externally attached to the spindle 9, with an anvil 13 pivotally supported at a front end of the hammer case 5. The anvil 13 is configured such that a bit (not shown) can be attached thereto by insertion.

Reference numeral 14 denotes a switch accommodated in an upper part of the handle 3 and provided in a driving circuit of the motor 4. Reference numeral 15 denotes a trigger that is provided so as to be energized and project forward from the switch 14. The trigger 15 turns on the switch 14 in response to pushdown operation. Between the trigger 15 and the hammer case 5, an extension portion 16 of the housing 2 is formed so as to project forward to cover a lower surface of the hammer case 5, and a light unit 17 is provided in the extension portion 16.

Figure 3:
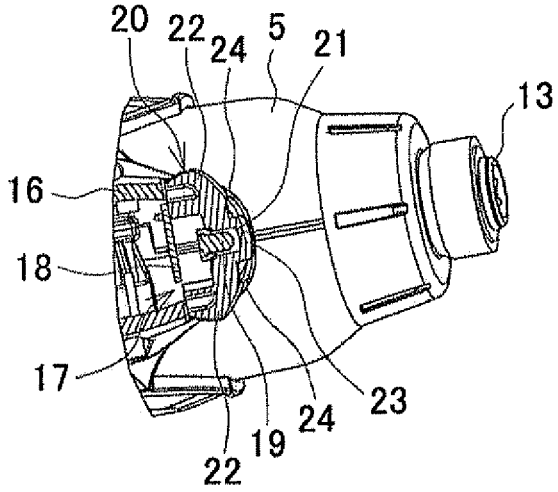
FIG. 3 is a partial cross-sectional view taken along a line A-A in FIG. 1.
Figure 4:
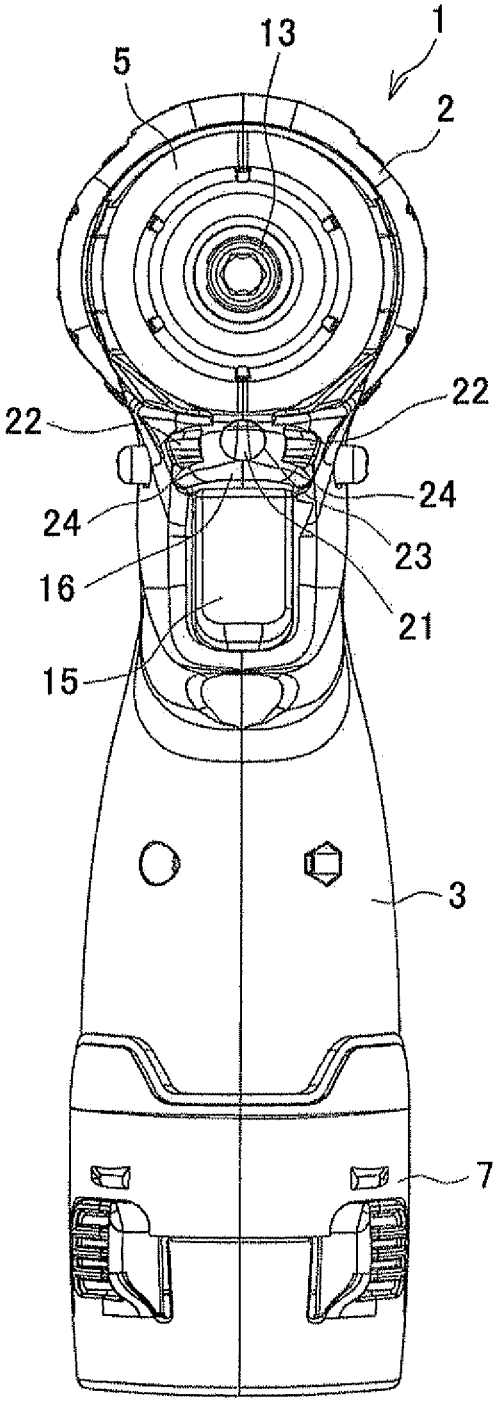
FIG. 4 is a front view of the rechargeable impact driver.
Figure 5:
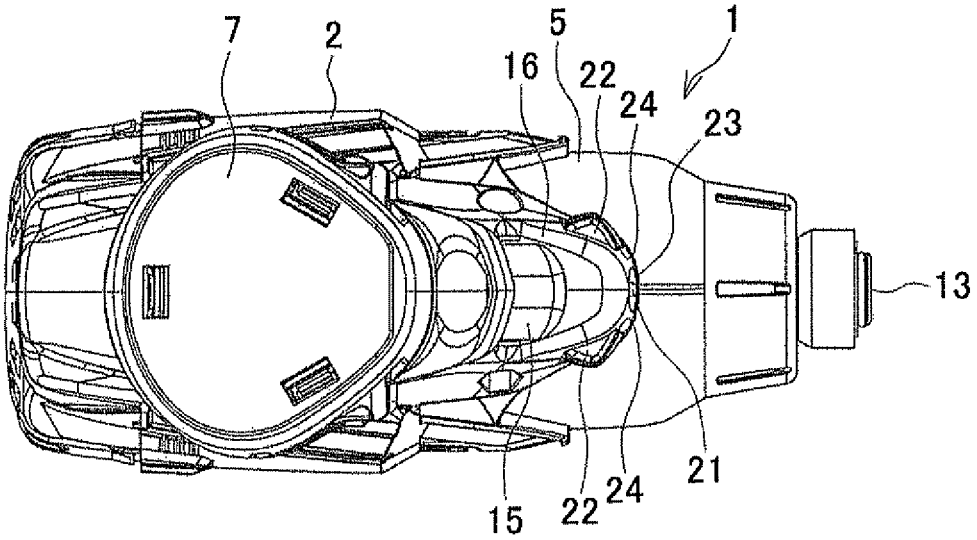
FIG. 5 is a bottom view of the rechargeable impact driver.

This light unit 17 includes a substrate 18 electrically connected to a controller (not shown) of the battery pack 7, an LED 19 serving as a light emitter disposed on the substrate 18 to face forward, and a lens 20 provided in front of the LED 19. The lens 20 is configured by integrally forming a front lens portion 21 and a pair of left and right side lens portions 22, 22. As illustrated in FIG. 3, the front lens portion 21 is a cylindrical diffusion lens that is formed so as to cover the LED 19 from its front side. The pair of left and right side lens portions 22, 22 are diffusion lenses that are provided contiguous to the front lens portion 21 at right and left sides thereof and swelling laterally. As illustrated in FIGS. 4 and 5, a circular central window 23 into which the front lens portion 21 fits so as to expose its front end is formed at a center in a left-to-right direction of a front end of the extension portion 16. A pair of quadrangular side windows 24, 24 are formed on right and left sides of the central window 23 so that front-to-side surfaces of the side lens portions 22, 22 are exposed therefrom. In an assembled state, the side lens portions 22, 22 laterally project from the extension portion 16 via the side windows 24, 24.

The LED 19 is controlled by a controller of the battery pack 7 such that it lights up upon turning on of the switch 14 to drive the motor 4 and flashes when a remaining battery level of the battery pack 7 becomes a given level or less. That is, a single LED 19 has both an illumination function to irradiate ahead of a bit attached to the anvil 13 and a notification function to notify a decrease in a battery level.

In the rechargeable impact driver 1 configured as above, when the trigger 15 is pushed to turn on the switch 14 and drive the motor 4, the spindle 9 rotates at a decreased speed to rotate the hammer 11 via the balls 10, 10 and rotate the anvil 13 with which the hammer 11 engages. This makes it possible to tighten a screw or the like by the bit attached to a tip of the anvil 13. When the screw is further tightened and torque of the anvil 13 is increased, the balls 10, 10 roll along a cam groove formed on a peripheral surface of the spindle 9. Then, the hammer 11 backs away against an energizing force of the coiled spring 12 while rotating relative to the spindle 9. When the hammer 11 is disengaged from the anvil 13, the hammer 11 moves forward while rotating due to the energizing force of the coiled spring 12. This causes the hammer 11 to engage with the anvil 13 again, thereby generating a rotational striking force (impact). By repeating the engagement and disengagement of the hammer 11 with respect to the anvil 13, retightening is performed.

During the drive of this motor 4, a circuit on the substrate 18 is energized and the LED 19 in the light unit 17 lights up, so that light from the LED 19 is diffused by the front lens portion 21 to irradiate ahead of the bit. This allows illumination to an area to be worked, and as a result, working properties are not spoiled even in a dark place. Further, although not being so bright as in the front lens portion 21, the light from the LED 19 is condensed and diffused in the left and right side lens portions 22, 22, which allows illumination at hand.

Figure 6:
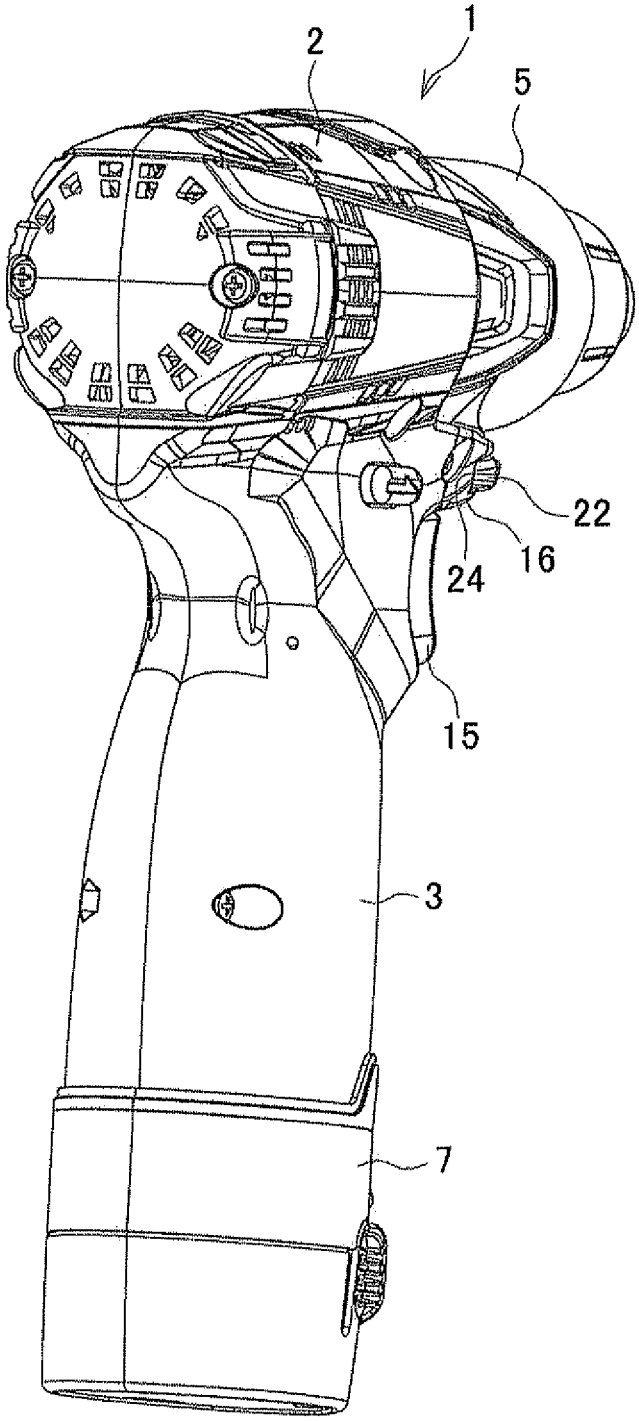
FIG. 6 is a perspective view of the rechargeable impact driver viewed from its back side.

On the other hand, when the battery level of the battery pack 7 is decreased due to use thereof and the remaining level becomes a given level or less, the LED 19 starts flashing. This causes the light irradiating ahead to flash on and off, so that an operator can easily recognize the decrease in the battery level. Particularly, the flashing of the LED 19 occurs even in the left and right side lens portions 22, 22, and accordingly, even when the rechargeable impact driver 1 is viewed from its back side as in FIG. 6, the flashing can be surely viewed through the side lens portions 22 projecting laterally.

Thus, in the rechargeable impact driver 1 of the above embodiment, a single LED 19 used for both the illumination function to irradiate ahead and a notification function to notify a decrease in a battery level is provided in the extension portion 16 of the housing 2. Therefore, even if the LED 19 is used for a plurality of functions such as the illumination function and the notification function, electric wiring is simplified. This makes it possible to suppress an increase in cost and to achieve downsizing.

Here, in particular, a function except the illumination function is the notification function to notify a decrease in a battery level, and therefore, it is possible to easily know the decrease in the battery level by using the LED 19.

Further, side lens portions 22, 22 are provided at respective sides of the LED 19 so as to project to right and left sides of the housing 2, so that the side lens portions 22, 22 are visible from a back side of the housing 2. Consequently, notification using the LED 19 can be easily recognized even if the rechargeable impact driver 1 is viewed from its back side.

Further, since the decrease in a battery level is notified by flashing of the LED 19, it is possible to surely notify the decrease in a battery level distinctively from the illumination function.

On the other hand, since the lens 20 is a diffusion lens, visibility of the LED 19 can be improved more.

Further, since the front lens portion 21 is provided in front of the LED 19 such that the front lens portion 21 and the side lens portions 22 are integrally formed, assembling is simple and positioning relative to the LED 19 can be performed easily.

It should be noted that in the above embodiment, the side lens portions of the lens is projected to the right and left sides so that they can be viewed from their back sides. However, scooped portions (recess portions) may be provided in the extension portion behind the side lens portions without projecting the side lens portions, so that the side lens portions can be viewed from their back side.

Further, in the above embodiment, a lens produced by integrally forming a front lens portion and side lens portions is used. However, the front lens portion and the side lens portions may be formed separately as different members and assembled to the extension portion.

Further, functions except the illumination function can be a notification function to notify a battery overheat and a notification function to notify a circuit abnormality as well as a notification function to notify a decrease in a battery level. These functions can be realized by a single light emitter by changing flashing patterns and the like.

On the other hand, a plurality of light emitters may be used for a plurality of functions, and an element except the LED may be used as the light emitter.

In addition, the electric power tool is not limited to a rechargeable impact driver, and the present invention is applicable to other types of electric power tool such as an electric drill and an electric driver. If the light emitter is not used for functions related to the battery, the electric power tool may not be of a rechargeable type.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An electric power tool comprising:

a housing;

at least one light emitter provided in the housing and used for a plurality of functions including an illumination function to irradiate ahead; and lenses are provided at respective sides of the light emitter so as to project to right and left sides of the housing so that the lenses are visible from a back side of the housing.

2. The electric power tool according to claim 1, further comprising:

a battery serving as a power supply, wherein a function except the illumination function is a notification function to notify a decrease in a battery level of the battery.

3. The electric power tool according to claim 2, wherein the decrease in the battery level of the battery is notified by flashing of the light emitter.

4. The electric power tool according to claim 1, wherein the lenses are diffusion lenses.

5. The electric power tool according to claim 1, wherein in addition to the lenses provided at the respective sides of the light emitter, another lens is provided in front of the light emitter such that the lens is formed integrally with the lenses provided at the sides of the light emitter.

6. The electric power tool according to claim 1, wherein the light emitter is an LED.

7. The electric power tool according to claim 1, wherein the light emitter is provided in an extension portion formed in the housing above a trigger of a switch.

8. The electric power tool according to claim 5, wherein the lens provided in front of the light emitter has a cylindrical shape.

* * * * *